US008186080B2

(12) United States Patent
Favreau et al.

(10) Patent No.: US 8,186,080 B2
(45) Date of Patent: May 29, 2012

(54) BOMB TOE CAP AND METHOD OF FORMING THE SAME

(75) Inventors: Christopher D. Favreau, Southbridge, MA (US); Linda B. McGinley, North Brookfield, MA (US); Zenon Smotrycz, Reading, MA (US)

(73) Assignee: Vibram Sp.A. (IT)

( * ) Notice: Subject to any disclaimer, the term of this patent is extended or adjusted under 35 U.S.C. 154(b) by 218 days.

(21) Appl. No.: 12/607,661

(22) Filed: Oct. 28, 2009

(65) Prior Publication Data

US 2011/0093997 A1 Apr. 28, 2011

(51) Int. Cl.
*A43B 23/08* (2006.01)

(52) U.S. Cl. ..... 36/72 R; 36/77 R

(58) Field of Classification Search ..... 36/72 R, 36/77 R, 77 M, 7.4, 7.7
See application file for complete search history.

(56) References Cited

U.S. PATENT DOCUMENTS

| | | | | | |
|---|---|---|---|---|---|
| 3,716,932 | A | * | 2/1973 | Pakulak | 36/72 R |
| 4,005,534 | A | * | 2/1977 | Crist et al. | 36/72 R |
| D252,296 | S | * | 7/1979 | Alegria | D2/913 |
| 4,526,828 | A | * | 7/1985 | Fogt et al. | 442/19 |
| 4,735,003 | A | * | 4/1988 | Dykeman | 36/77 R |
| 5,251,386 | A | * | 10/1993 | Diaz | 36/2 R |
| 5,667,857 | A | * | 9/1997 | Watanabe et al. | 428/36.2 |
| D391,744 | S | * | 3/1998 | McMaster | D2/913 |
| 5,979,081 | A | * | 11/1999 | Vaz | 36/107 |
| D435,715 | S | * | 1/2001 | Hunter et al. | D2/913 |
| D437,105 | S | * | 2/2001 | Mahjied | D2/913 |
| D470,647 | S | * | 2/2003 | Johnson | D2/913 |
| 2007/0289165 | A1 | * | 12/2007 | Sartor et al. | 36/77 R |

* cited by examiner

*Primary Examiner* — Ted Kavanaugh
(74) *Attorney, Agent, or Firm* — Cantor Colburn LLP

(57) ABSTRACT

An article is provided and includes a first ballistic particle impenetrable material, which is formable into a pack and a second material, which is formable into an enclosure for the pack, the enclosure having an interior facing surface in abutment with a substantial entirety of an exterior of the pack.

5 Claims, 2 Drawing Sheets

BOMB TOE CAP AND METHOD OF FORMING THE SAME

BACKGROUND

Aspects of the present invention are directed to a bomb toe cap and methods of forming the same.

Bomb disposal is the process by which hazardous explosive devices are rendered safe and describes separate but interrelated functions in military and public safety settings. It is generally handled by explosive ordinance disposal (EOD) technicians and improvised EOD technicians in military settings and public safety bomb disposal (PSBD) technicians and bomb squads in the civilian settings. Recently, the importance of these technicians and their safety has become important because of the development of powerful, difficult to detect explosives such as RDX (cyclotrimethylenetrinitramine), Sematex, C-4, and the like. Explosives such as RDX, Sematex and C-4, are difficult to detect and are more destructive than their conventional counterparts such as TNT, dynamite, gunpowder, and the like. It is therefore desirable to have protective gear that can adequately protect technicians against these powerful explosives.

Safety for bomb disposal technicians can relate to the skills and expertise they apply during bomb disposal operations and to the equipment they use. That equipment includes fire resistant suits and armor plating. The armor plating can be used in various places on the suits to deflect or otherwise impede ballistic particles approaching the wearer at high speeds should an explosive device be detonated nearby.

Generally, the armor contains a material that is impenetrable to such high-speed ballistic particles and a pocket in which the impenetrable material is held. A problem exists, however, in that the pocket must be relatively comfortable for the wearer and yet sufficiently rigid to maintain the armor in a safe position and orientation. This combination of considerations is typically difficult to fully achieve. Moreover, it has been seen that the impenetrable material frequently deteriorates upon exposure to environmental conditions. However, the pocket rarely provides protection against such material deterioration.

SUMMARY

In accordance with an aspect of the invention, an article is provided and includes a first ballistic particle impenetrable material, which is formable into a pack and a second material, which is formable into an enclosure for the pack, the enclosure having an interior facing surface in abutment with a substantial entirety of an exterior of the pack.

In accordance with another aspect of the invention, an article to be worn for protection by a user is provided and includes a first ballistic particle impenetrable material, which is formable into a pack having a shape that mimics a shape of a portion of a body of the user to be protected and a second material, which is formable into an enclosure for the pack, the enclosure having a shape similar to that of the pack and an interior facing surface in abutment with a substantial entirety of an exterior of the pack.

In accordance with yet another aspect of the invention, a method for forming an article is provided and includes forming a first ballistic particle impenetrable material into a pack and forming a second material into an enclosure for the pack, the enclosure having an interior facing surface in abutment with a substantial entirety of an exterior of the pack.

BRIEF DESCRIPTIONS OF THE SEVERAL VIEWS OF THE DRAWINGS

The subject matter regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

DETAILED DESCRIPTION

Figure 1:
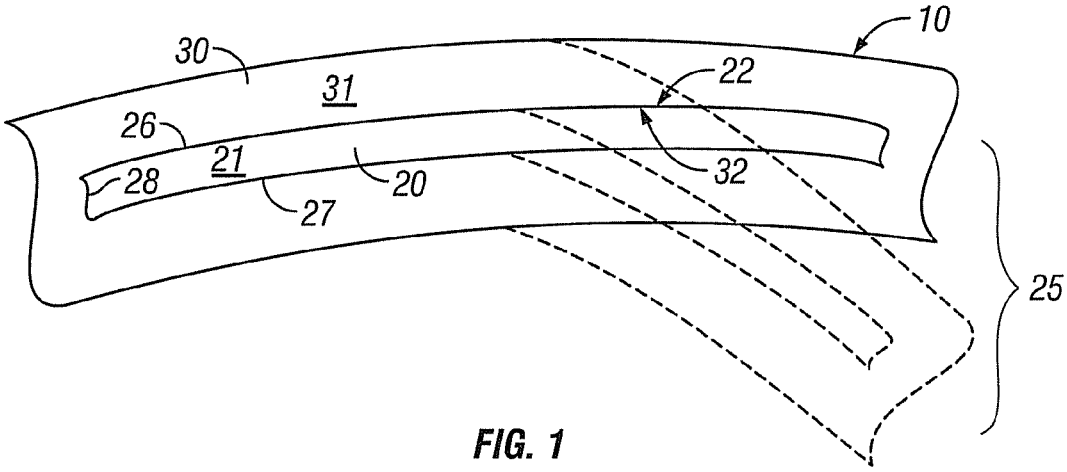
FIG. 1 is a schematic view of an article in accordance with an embodiment of the invention.
Figure 2:
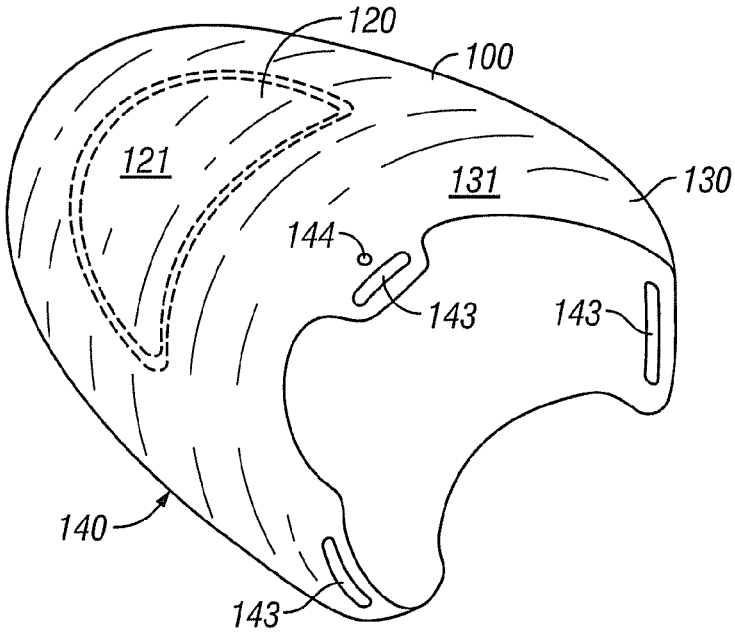
FIG. 2 is a perspective view of a bomb toe cap in accordance with embodiments of the present invention.
Figure 3:
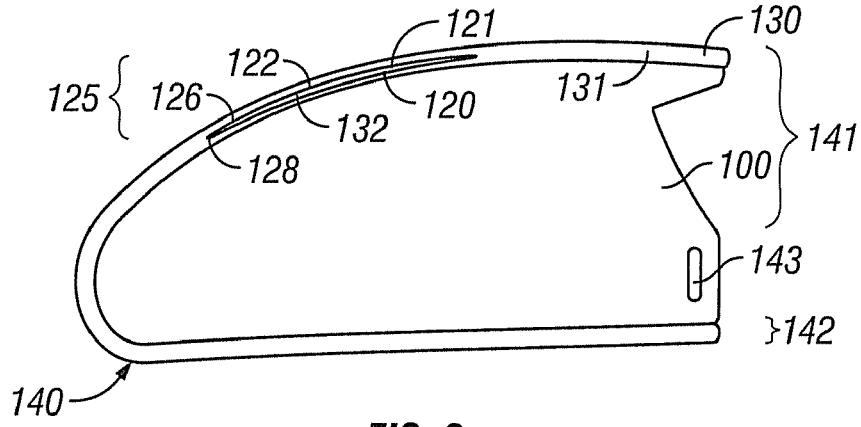
FIG. 3 is a side view of the bomb toe cap of FIG. 2.
Figure 4:
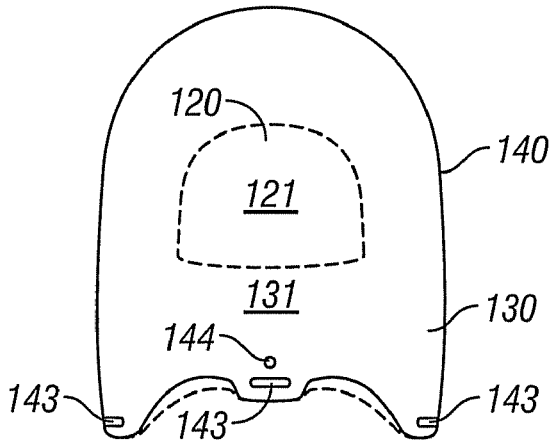
FIG. 4 is a top view of the bomb toe cap of FIG. 2.

With reference to FIG. 1, an article 10 is provided. The article 10 includes a first ballistic particle impenetrable material 20, which is formable into a pack 21, and a second material 30. The second material 30 is formable into an enclosure 31 for the pack 21 and has an interior facing surface 32 that is configured to be disposable in abutment with a substantial entirety of an exterior 22 of the pack 21. In this way, the first material 20 is encased within the second material 30 with little to no space in between such that exposure of the first material 20 to environmental conditions is minimized. Moreover, the orientation of the first material 20 can be directly controlled by way of orientation control of the second material 30. That is, if the enclosure 30 is rotated, the pack 20 is also rotated in substantially the same manner.

In one aspect, the first material 20 may include a weave. In another aspect, the first material 20 may include a plurality of weaves each having a different orientation when compared with a neighboring weave. In yet another aspect, the first ballistic particle impenetrable material 20 may include a plurality of weaves, where each weave is separated by a layer of the second material 30.

The first material 20 may include a monolithic piece of material i.e., a single unitary piece of material that is indivisible. The monolithic material is generally molded prior to incorporation in the article 10. In one aspect, the first material 20 may comprise a plurality of monolithic pieces, where each monolithic piece is separated by a layer of the second material 30. The monolithic pieces separated by the layer of the second material 30 can be arranged in a horizontal place or in a vertical plane.

In yet another aspect, the first material 20 may be dispersed in the second material 30 to form the pack 21. The pack 21 may comprise about 30 to about 90 weight percent (wt %), specifically about 40 to about 80 wt %, and more specifically about 50 to about 75 wt % of the first material based on the total weight of the first material 20 and the second material 30 in the pack 21.

The first material 20 is impenetrable to ballistic particles, such as bomb shrapnel that may be blown toward an EOD technician during an explosive event. To this end, the first material is selected from the group including aramids e.g., (KEVLAR®, NOMAX®, TECHNORA®, TWARON®), ultrahigh molecular weight polyethylene (e.g., SPECTRA®, DYNEEMA®, GARDUR®, TENSYLON®), polycarbonate (e.g., LEXAN®, CALIBRE®, MAKROLON®), bullet resistance fiberglass, carbon fiber composite materials, ceramics, steel, titanium, and a combination comprising at least one of the foregoing materials. An exemplary first material is KEVLAR®.

The first material 20 may also be rigid or flexible as necessary for specific applications. For example, where the first material 20 is to protect an EOD technician's torso or a side of a military vehicle, the first material 20 need not flex during normal operations and, thus, can be made substantially rigid. On the other hand, where the first material 20 is to protect an EOD technician's limbs or feet, the first material 20 can be made flexible to accommodate movement. In one embodiment, it is generally desirable for the first material 20 to be capable of protecting the technician's limbs or feet from penetration by shrapnel or flying debris. It is desirable for the first material 20 to be impenetrable by a fragment of debri weighing at least 6 grams travelling at a speed of at least 200 meters per second. In another embodiment, it is generally desirable for the first material 20 to be impenetrable by a fragment of debri weighing at least 8 grams travelling at a speed of at least 300 meters per second. In yet another embodiment, it is generally desirable for the first material 20 to be impenetrable by a fragment of debri weighing at least 8 grams travelling at a speed of at least 350 meters per second.

The second material 30 is formable into the enclosure 31 as described below and is an organic polymeric material. The organic polymeric material can be a thermoplastic polymer, a blend of thermoplastic polymers, a thermosetting polymer, a blend of thermosetting polymers, or blends of thermoplastic polymers with thermosetting polymers. The organic polymeric material may include semi-crystalline polymers or amorphous polymers. Exemplary organic polymeric materials are elastomers. In one embodiment, it is desirable for the organic polymeric material to have a tensile elastic modulus when measured at room temperature at a rate of less than or about 5 centimeters per minute of less than or equal to about $10^7$ Pascals, specifically less than or equal to about $10^6$ Pascals, and more specifically less than or equal to about $10^5$ Pascals.

The second material 30 may be monolithic (a solid unitary undivisible material). In one embodiment, the second material 30 is foamed having a porosity of about 10 to about 99 volume percent, specifically about 20 to about 80 volume percent, and more specifically about 30 to about 70 volume percent, based on the total volume of the second material 30. The presence of a porous second material 30 permits the article 10 to breathe. The second material 30 may comprise open cells, closed cells, or a combination of open cells and closed cells.

In another embodiment, the second material 30 may be non-porous having a porosity of about 1 to about 10 volume percent, specifically less than or equal to about 8 volume percent, and more specifically less than or equal to about 6 volume percent, based upon the total volume of the entire second material 30.

The thermoplastic polymer may also be a blend of polymers, copolymers, terpolymers, or combinations including at least one of the foregoing thermoplastic polymers. The thermoplastic polymer can also be an oligomer, a homopolymer, a copolymer, a block copolymer, an alternating block copolymer, a random polymer, a random copolymer, a random block copolymer, a graft copolymer, a star block copolymer, a dendrimer, or the like, or a combination comprising at last one of the foregoing thermoplastic polymers.

Examples of the thermoplastic polymers are polyacetals, polyolefins, polyacrylics, polycarbonates, polystyrenes, polyesters, polyamides, polyamideimides, polyarylates, polyarylsulfones, polyethersulfones, polyphenylene sulfides, polyvinyl chlorides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polypyrrolidines, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polyphthalides, polyacetals, polyanhydrides, polyvinyl ethers, polysilazanes, polyurethanes, fluoropolymers, polysiloxanes, or the like, or a combination comprising at least one of the foregoing thermoplastic polymers.

Examples of thermosetting polymers include epoxy polymers, unsaturated polyester polymers, polyimide polymers, bismaleimide polymers, bismaleimide triazine polymers, cyanate ester polymers, vinyl polymers, benzoxazine polymers, benzocyclobutene polymers, acrylic polymers, acrylate polymers, methacrylate polymers, polyalkyds, phenolformaldehyde polymers, novolac polymers, resole polymers, melamine-formaldehyde polymers, urea-formaldehyde polymers, polyhydroxymethylfurans, polyisocyanates, diallyl phthalate polymers, triallyl cyanurate polymers, triallyl isocyanurate polymers, unsaturated polyesterimides, polyurethanes, or the like, or a combination comprising at least one of the foregoing thermosetting polymers.

As noted above, the second material 30 is, in some embodiments, an elastomer. The elastomers may be thermoplastic or thermosetting elastomers. Examples of elastomers are natural rubber, synthetic polyisoprene, butyl rubber (copolymer of isobutylene and isoprene), halogenated butyl rubbers (e.g., chloro butyl rubber, bromo butyl rubber), polybutadiene, styrene-butadiene rubber (copolymer of polystyrene and polybutadiene), nitrile rubber (copolymer of polybutadiene and acrylonitrile), also called BUNA N® rubbers, hydrogenated nitrile rubbers such as, for example, THERBAN® and ZETPOL®, carboxylated nitrile rubbers (e.g., XNBR), chloroprene rubber, such as, for example, NEOPRENE and BAYPREN, ethylene propylene rubbers (e.g., ethylene propylene rubber, a copolymer of ethylene and propylene and ethylene propylene diene rubber, a terpolymer of ethylene, propylene and a diene-component), epichlorohydrin rubber, polyacrylic rubber, silicone rubber, fluorosilicone rubber, fluoroelastomers, perfluoroelastomers, polyether block amides, chlorosulfonated polyethylene, ethylene-vinyl acetate, or the like, or a combination comprising at least one of the foregoing elastomers. An exemplary elastomer is a carboxilated nitrile rubber such as XNBR commercially available from Robinson Rubber Products Company Inc.

The second material 30 may be electrically conducting. The use of an electrically conducting second material 30 prevents the generation of sparks by the article 10 thereby minimizing the possibility of an explosion caused by electrostatic buildup on the article 10. In one embodiment, the second material 30 may be electrically conducting having an electrical resistivity of less than or equal to about $1\times10^{11}$ ohm-cm, specifically less than or equal to about $1\times10^9$ ohm-cm, and more specifically less than or equal to about $1\times10^6$ ohm-cm.

The second material 30 may be rendered electrically conducting by the incorporation of electrically conducting fillers such as carbon nanotubes (single wall carbon nanotubes, multiwall carbon nanotubes), carbon black, metal particles, metal coated fillers, carbon fibers, polycyclic aromatic fillers such as phthalocyanines, pyrenes, anthracenes, and the like; or the like, or a combination comprising at least one of the foregoing electrically conducting fillers.

Other additives such as, for example, anti-oxidants, anti-ozonants, anti-bacterial agents, mold release agents, reinforcing fillers (e.g., silica, titania, or the like), colorants, plasticizers, accelerators, vulcanization packages, inhibitors, or the like, or a combination comprising at least one of the foregoing additives may be added to the second material 30.

Both the first material 20 and the second material 30 may be heat/flame resistant or, in other embodiments, one or the other may be heat/flame resistant. Heat resistance, whether provided by one or the other of the materials, provides an added layer of protection to an EOD technician during an explosive event during which the air around an explosive device is heated beyond safe limits. In particular, where the second material 30 provides the heat resistance, the need for the first material 20 to also do so is reduced and greater freedom is available in selecting an appropriate option for the first material 20.

Further, where the first material 20 is to protect a given object, the pack 21 may be provided in various shapes and sizes appropriate for that object. For example, where the object is an EOD technician's torso, which has a generally flat surface, the pack 21 may be plate shaped with little or no curvature. On the other hand, where the object is the EOD technician's foot, which has a curved upper surface, the pack 21 may have a curvature 25 that mimics the curvature of the upper surface. In most cases, regardless of the need for the pack 21 to be curved or otherwise irregularly shaped, the pack 21 will have generally opposable faces 26 and 27 and sidewalls 28 extending between the faces 26 and 27.

With reference to FIGS. 2, 3, 4 and 5, an article 100 to be worn by a user for protection from for example shrapnel blown towards the user by an explosive event is provided. The article 100 includes a first ballistic particle impenetrable material 120, which is similar to the first material 20 discussed above, and which is formable into a pack 121 having a shape that mimics a shape of a portion of a body of the user to be protected, and a second material 130. The second material 130 is similar to the second material 30 discussed above and is formable into an enclosure 131 for the pack 121. The enclosure 131 has a shape, which is similar to that of the pack 121 and an interior facing surface 132 that is disposable in abutment with a substantial entirety of an exterior 122 of the pack 121. In this way, as before, the first material 120 is encased within the second material 130 with little to no space in between such that exposure of the first material 120 to environmental conditions is minimized. Moreover, the orientation of the first material 120 can be directly controlled by way of orientation control of the second material 130. That is, if the enclosure 131 is rotated, the pack 121 is also rotated in substantially the same manner.

In accordance with embodiments of the invention, the portion of the body of the user to be protected comprises the upper surface of the user's foot. It is, however, understood that this is merely exemplary and that any portion of the user's body can be protectable in accordance with embodiments of the invention.

In order to protect the upper surface of the user's foot, the pack 121 is generally plate-shaped, with opposing faces 126 and 127 and sidewalls 128, and has a curvature 125 that mimics the curvature of the user's foot. Here, it is noted that the curvature 125 and its dimensions can be customized to exactly match the user's foot curvature or, in alternate embodiments, the curvature 125 can be preselected to be sufficient for use with any user's foot curvature.

The enclosure 131 may be included in a shoe-shaped body 140 formed of the second material 130 and/or additional materials as necessary. The shoe-shaped body 140 may include an upper 141, in which the enclosure 131 would generally be located, and a sole 142. The upper 141 and the sole 142 may be joined together to form an interior that is receptive of the user's foot and/or additional articles worn thereon.

In accordance with embodiments of the invention, the shoe-shaped body 140 may be formed to define attachment portions 143 by which the shoe-shaped body 140 is attachable to the user's foot. In an exemplary embodiment, the attachment portions 143 may be slots disposable on opposite sides of and above the user's foot and through which a foot strap that is extendable around the user's ankle may be threaded. In any case, the attachment portions 143 are configured with respect to the second material 130 to be structurally sound and to withstand the force of an explosive event proximate to the user such that, in at least some cases, the user will be prevented from being blown out of the shoe-shaped body 140 and provide some level of protection in the event of a second explosion.

In accordance with further embodiments of the invention, the shoe-shaped body 140 may also be formed to define a static electricity discharge portion 144 by which static electricity is dischargeable from either or both of the first and second materials 120 and 130. In an exemplary embodiment, the static electricity discharge portion 144 may be formed as a through-hole defined in a selected portion of the shoe-shaped body 130 through which electrically conductive wiring can be threaded.

Figure 5:
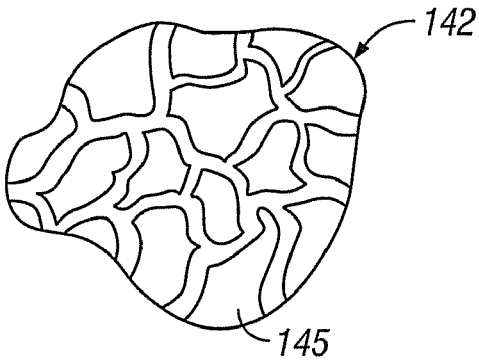
FIG. 5 is a bottom schematic view of the bomb toe cap of FIG. 2.

As shown in FIG. 5, the sole 142 may be formed of the second material 130 and/or another similar material and is configured to be stood upon during normal bomb disposal operations. To this end, the sole 142 may be formed with a preselected lug pattern 145 that provides an appropriate level of friction between the sole 142 and the surface upon which the user stands at any given time and particularly during bomb disposal operations.

In accordance with another aspect of the invention, a method for forming an article is provided and includes forming a first ballistic particle impenetrable material into a pack, and forming a second material into an enclosure for the pack, the enclosure having an interior facing surface in abutment with a substantial entirety of an exterior of the pack. In accordance with this method, the forming of the first material may include preheating the first material and the forming of the second material may include pressing and heat curing the second material into, for example, a shoe-shaped body that includes the enclosure. A specially engineering mold may be required for forming the shoe-shaped body. The bomb toe cap may be manufactured in a batch process or in a continuous process.

In greater detail, where the first material is Kevlar®, for example, the Kevlar® pack is preheated on a press. The press temperature is about 125 to about 300 degrees Centigrade (C), specifically about 150 to about 250 degrees C., and more specifically 175 to about 200 degrees C. In an exemplary aspect, the press temperature set to about 178 degrees C. Alternatively, the pack could be preheated in an oven. In either case, allowing moisture to become trapped in the Kevlar® should be avoided as moisture can cause the second material to blister and may degrade the Kevlar®.

A first preform of the second material is then loaded onto a mold and is pushed down so that the preform follows the curve, if any, of the mold and so that movement of the preform relative to the mold can be minimized. Loose Kevlar® strands are then bent back over the pack or cut off and the Kevlar® pack is loaded onto the preform with the pack positioned as accurately as possible. A second preform is then loaded onto the pack and pushed down so that the second preform follows the curve, if any, of the mold and sits on the pack. A mandrel is then placed onto the performs and the pack to increase pressures applied thereto and a bottom preform is laid in alignment over the mandrel. The mandrel is removable and guided so that when it is placed into the mold, the proper thickness between the mandrel and the mold can be maintained so that the rubber thickness above and below the Kevlar® is consistent. The assembled article is then pressed together and cured for a given time, such as ten minutes with additional bumps executed as necessary. Once the curing is complete, flashing can be removed from the article with a knife, the article can be removed from the press and the mandrel can be removed from the article. The article is then cooled and trimmed into its final shape.

The bomb toe cap may also be manufactured in a continuous process that involves extrusion and/or molding. The molding may involve compression molding or injection molding. The injection molding may be reaction injection molding, liquid injection molding, or the like, thermoplastic injection molding or thermosetting injection molding. In one aspect, the first pack 21 may be manufactured by injection molding into a first mold with the enclosure for the first pack 21 being injection molded into an adjacent second mold. The first pack 21 may be partially cured prior to the injection molding of the enclosure. The first pack 21 may be fused with the enclosure to produce the bomb toe cap. The bomb top cap can then be completely cured.

Quality standards of the article can be monitored so as insure user safety to a reasonable degree. For example, the second material can be inspected for interior bubbles that are sufficiently small such that they do not degrade the ability of the second material to stick to the Kevlar® pack. In an example, widths of such bubbles should not exceed the stitch spacing of the Kevlar® pack. Also, it is understood that flashing, which is greater than about 1/16th of an inch, should be substantially entirely removed from the article but that gouging, which is greater than about 3/8ths of an inch long and about 1/16th of an inch wide, is unacceptable. Similarly, Kevlar® fibers can poke through the second material as long as they are less than 1/4th of an inch long and no more than 1 layer of thread. Contamination, surface blisters, surface cracks and cancers, which are areas of very small surface bubbles, should all be removed or substantially avoided.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular exemplary embodiment disclosed as the best mode contemplated for carrying out this disclosure, but that the disclosure will include all embodiments falling within the scope of the appended claims.

What is claimed is:

1. An article to be worn for protection by a user, comprising:

a first ballistic particle substantially impenetrable material, which is formable into a pack having a shape that mimics a shape of a portion of a body of the user to be protected; and a second material, which is formable into a monolithic wearable article having opposing sides and a top portion and a sole that extend between the opposing sides such that the wearable article has a closed front end and an open rear end that is receptive of a frontal part of the portion of the body of the user, wherein attachment portions through which a foot strap extendable about the portion of the body of the user is threadable are formed at the opposing sides and the top portion and at least the top portion is formed as an enclosure for the pack, the enclosure having a shape similar to that of the pack and an interior facing surface disposed such that a substantial entirety of the interior facing surface abuts a substantial entirety of an exterior of the pack.

2. The article according to claim 1, wherein the portion of the body of the user to be protected comprises the foot.

3. The article according to claim 2, wherein the second material is formable into a shoe-shaped body including the enclosure.

4. The article according to claim 3, wherein the shoe-shaped body is formed to define a static electricity discharge portion.

5. The article according to claim 1, wherein the sole is formed with a preselected lug pattern to provide traction.

* * * * *